United States Patent [19]

Horlitz, Jr. et al.

[11] Patent Number: 4,633,818

[45] Date of Patent: Jan. 6, 1987

[54] MOBILE COAL-FIRED FLUIDIZED BED POWER UNIT

[75] Inventors: Carl F. Horlitz, Jr., Windsor; Franciscek J. Swietek, Hartford, both of Conn.

[73] Assignee: Combustion Engineering, Inc., Windsor, Conn.

[21] Appl. No.: 811,213

[22] Filed: Dec. 20, 1985

[51] Int. Cl.[4] ..... F22B 1/00

[52] U.S. Cl. ..... 122/4 D; 105/43; 105/45; 110/202; 110/263; 122/235 Y; 122/328; 122/347; 122/434

[58] Field of Search ..... 110/245, 263, 198–202, 110/240, 281; 122/4 D, 3, 136 R, 140 R, 140 A, 154, 347, 328, 235 Y, 434; 105/37, 38, 43, 45, 46, 48.1

[56] References Cited

U.S. PATENT DOCUMENTS

| | | | |
|---|---|---|---|
| 2,241,129 | 5/1941 | Hathaway et al. | 110/198 |
| 2,274,395 | 2/1942 | Badenhausen | 105/38 |
| 2,608,938 | 9/1952 | Hardgrove | 122/347 X |
| 2,879,717 | 3/1959 | Bailey et al. | 122/235 Y |
| 4,336,769 | 6/1982 | Daman | 110/245 X |
| 4,425,763 | 1/1984 | Porta et al. | 110/198 X |
| 4,491,077 | 1/1985 | Petty et al. | 110/281 X |

FOREIGN PATENT DOCUMENTS

| | | | |
|---|---|---|---|
| 2109096 | 5/1983 | United Kingdom | 122/434 |

*Primary Examiner*—Albert J. Makay
*Assistant Examiner*—Steven E. Warner
*Attorney, Agent, or Firm*—William W. Habelt

[57] ABSTRACT

A mobile coal-fired fluidized bed furnace system (10) is provided for generating steam to power a locomotive. Coal is combusted within the fluidized bed furnace chamber (30) in the fluidizing air to produce a hot flue gas which pass from the furnace chamber (30) through a boiler tank (90) and an economizer (34). The steam generated in the boiler bank and the walls of the furnace chamber is collected in steam drum (40) and passed therefrom through an in-bed superheater (100) and thence to the power generating means (22) to produce the power which drives the locomotive.

3 Claims, 7 Drawing Figures

MOBILE COAL-FIRED FLUIDIZED BED POWER UNIT

The present invention relates to fluidized bed steam generators and, more particularly, to a mobile coal-fired fluidized bed steam generator particularly adapted for use with a locomotive or a ship.

For about the past forty years, almost all locomotives and ships that have been built have been powered by oil based fuels rather than coal. Diesel fuel and heavy oil replaced coal as the fuel to power locomotives and ships, respectively, due to their ease of handling of diesel fuel, their relatively clean burning characteristics and, of course, their high availability and attractive cost. However, in the late seventies and early eighties, the availability of oil-based fuels diminished with the reduction in world oil production resulting in a sharp upturn in price of oil based fuels during the energy crisis. As a result, interest in coal-fired steam generators for powering locomotives and ships was rekindled during the energy crisis and, although it has dwindled somewhat due to lower oil prices and increased production, the interest in coal-powered drive systems for locomotives and ships is expected to heighten again when oil prices return to their previous highs.

Prior coal-fired locomotives were typically powered by steam generating furnaces of the wall-fired type wherein coal- fired burners were mounted in one end wall of the furnace or by stoker-fired furnaces wherein the coal was burned on a traveling grate. in a two or three inch layer on the surface of the grate. For example, U.S. Pat. Nos. 2,274,395 and 2,608,938 disclose mobile coal-fired steam generators for powering locomotives wherein the furnace of the steam generator is of the wall-fired type. U.S. Pat. No. 2,879,717 discloses a steam powered locomotive having a water tube steam generator which utilizes a stoker coal-fired furnace wherein the coal is burned in a thin layer on a traveling grate. More recently, U.S. Pat. No. 4,425,763 was granted for a coal-fired steam locomotive powered by reciprocating steam engines with the steam supplied from a coal-fired steam generator, again utilizing a stoker- type furnace wherein the coal to be burned is fed to the top of the grate through an opening in the side wall of the furnace.

Although fluidized bed steam generating furnaces have been in development for a number of years, the emphasis of this development has been on fluidized bed furnaces which generate steam for utilities for producing electricity or generating process steam for industrial purposes. Such stationary, land- based fluidized bed furnaces are not readily usable as power units for mobile transportation devices such as locomotives or ships. Power units inlocomotives and ships are subject to various conditions not experienced in land-based installations.

For instance, locomotives and ships obviously are not stationary. Locomotives must be capable of operating at elevations of sea level and even below in some areas to elevations of 8,000 feet for crossing mountain passes. In going from sea level to an elevation of 8,000 feet, there is a significant decrease in air density which results in greater air volumes being passed through the furnace. Thus, the air velocity within the furnace will necessarily increase as the locomotive travels to higher elevation. Therefore, the furnace must be designed so as to be capable of accepting such a velocity change.

Additionally, both ships and locomotives are subject to tilting and listing motions. Therefore, any fluidized bed utilized to power a ship or a locomotive must be specifically adapted to accommodate a tilting of the bed when the locomotive goes up or downhill or when a ship is crossing waves. Additionally, the bed would be subject to a side-to-side listing motion when the locomotive negotiates a banked curve or when the ship is subjected to a wave from the side. Accordingly, a fluidized bed furnace for powering a locomotive or a ship must be particularly adapted to reduce or accommodate a sloshing motion within the bed material.

Also, a fluidized bed for powering a ship or locomotive must be capable of operation over a very wide load range and idling at low power for long periods of time. When a locomotive is stationary at a terminal or in a switch yard, or when a ship is in port, the fluidized bed furnace must be capable of operating at a load of about 20% of the maximum load. However, when the locomotive engine is pulling a long train of cars up a hill, or when a fully loaded cargo ship is being operated at full steam on the high seas, the fluidized bed furnace must be capable of operating at full load for long periods of time.

Further, a fluidized bed furnace for powering a locomotive or a ship must be a very compact unit. The bed width and length must be such that it can be accommodated within the confines of a locomotive engine or a ship hull. Additionally, the height of the fluidized bed furnace is limited as the fluidized bed furnace must be installed in a locomotive engine capable of going under bridges or through tunnels or into the hull of a ship between decks.

One feature of the fluidized bed boiler which is particularly attractive for use in powering locomotives or ships is its ability to cleanly combust coal which, although a relatively cheap fuel and readily available in the United States, is also a dirty fuel. When coal is combusted, sulfur in the coal is necessarily converted to sulfur oxides by oxidation during the combustion process. Additionally, nitrogen in the coal and in the combustion air will be converted to nitrogen oxides by oxidation in the combustion process. In conventional wall-fired or stoker grate furnaces, the emission of sulfur oxides can be controlled only by burning a more expensive low sulfur fuel and/or removing the sulfur oxides from the flue gas before venting to the atmosphere by rather elaborate and cumbersome flue gas scrubbing equipment. Similarly, the combustion process in conventional wall-fired or stoker grate furnaces must be closely monitored to provide proper air distribution in order to control the formation of nitrogen oxides during combustion. Therefore, with environmental concerns in mind, it would be unacceptable to-operate a locomotive in a terminal or switch yard or a ship in port while releasing pollutants such as sulfur and nitrogen oxides into the atmosphere. For conventional wall-fired or stoker grate coal-fired furnaces to be utilized to power locomotives or ships, provisions would have to be made to include flue gas scrubbing equipment to chemically remove the sulfur oxides from the flue gas prior to venting the flue gas to the atmosphere. Such equipment is not only expensive but also very space consuming, therefore making conventional wall-fired or stoker grate furnaces unattractive for powering locomotives or ships.

However, by including a sulfur absorbing material in the bed of a fluidized bed furnace, run of the mine coal having a high sulfur content can be combusted in a very clean manner with the major portion of the sulfur oxides generated during the combustion process being absorbed by the sulfur absorbing material in the bed. Therefore, the sulfur oxides do not enter the flue gas stream as a gas but rather are collected as a solids particulate to be removed together with the particulate ash material which is always generated during coal combustion. Further, as fluid bed combustion systems are customarily operated at temperatures in the range of 1600 F. to 1800 F., the formation of nitrogen oxides is substantially lower than that occurring in conventional wall-fired and stoker grate furnaces.

SUMMARY OF THE INVENTION

A mobile coal-fired fluidized bed furnace system is provided for producing a hot flue gas which is passed in heat exchange relationship with a liquid to generate and superheat a vapor for powering a locomotive.

The coal-fired fludized bed furnace system of the present invention includes a longitudinally elongated furnace enclosure formed of a plurality of fluid-cooled tubes enclosing a furnace chamber having an open floor at the bottom thereof, an evaporator section having a gas inlet opening to the furnace chamber, and an economizer section having a gas inlet opening to said evaporator section. The furnace chamber, the evaporator section and the economizer are arranged longitudinally in that sequence with respect to flue gas flow. The evaporator section includes an elevated longitudinally extending steam and water drum, a pair of laterally spaced, longitudinally extending lower water headers disposed beneath and spaced from the steam and water drum, and a boiler bank formed of a plurality of fluid-cooled tubes extending vertically upward from each of the lower inlet headers to the steam and water drum. A superheater tube bundle is disposed within the furnace chamber and uniquely supported therein from tubes forming the side walls so as to be immersed within said bed of fluidized material.

A support plate is positioned to extend across the open floor of the furnace chamber for supporting a bed of fuel material and an inert material. Fuel feed means extend upwardly through the support plate for supplying particulate material to the bed. An air plenum is disposed immediately subadjacent the support plate for directing air through a plurality of passages through the support plate into the bed to fluidize the fuel and inert material within the furnace chamber superadjacent the support.

The fluidized bed furnace system is supported on a support cradle adapted for mounting on a locomotive frame or in a ship hull or on a rail car. The support cradle has a base member upon which the air plenum and bed support plate are supported and a longitudinally extending side member from which the furnace enclose is supported. In this manner, the furnace enclosure together with its associated headers is supported independently of the bed of material.

DETAILED DESCRIPTION OF A PREFERRED EMBODIMENT

Figure 1:
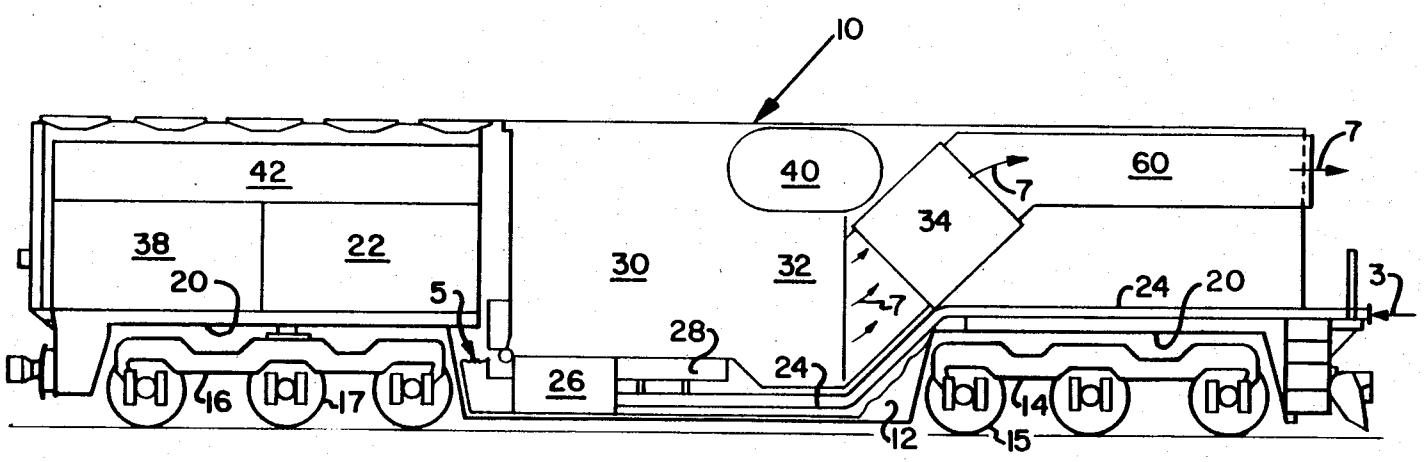
FIG. 1 is a schematic illustration of a locomotive engine powered by a preferred embodiment of the coal-fired fluidized bed steam generator of the present invention.

The present invention will be described hereinafter with reference to a preferred embodiment illustrated in the drawings wherein a mobile coal-fired fluidized bed is installed in a locomotive engine as the power unit therefor. However, it is to be understood that the invention is not to be limited to the specific embodiment so illustrated and that the present invention may be utilized as a power unit in other mobile transportation devices such as ships, or as a rail-shippable or rail-mobile power plant.

Referring now to the drawings, and specifically FIG. 1 thereof, there is depicted therein a locomotive steam engine including as the steam generating unit a fluidized bed furnace system generally designated as 10. The fluidized bed furnace system 10 is arranged on a support cradle 12 disposed beneath the fluidized bed furnace system 10 and interconnected with the main frame 20 which is supported in a conventional manner upon front and rear trucks 14 and 16 which in turn are mounted respectively on front wheels 15 and rear wheels 17.

Steam is generated to drive the power generating means 22 by combusting particulate coal in a fluidizied bed within the lower region of the furnace enclosure 30. Particulate coal 3 to be burned in the fluidized bed furnace is supplied to the furnace enclosure 30 pneumatically through feed line 24 from a coal tender car (not shown). Preheated combustion air 5 is supplied through air plenums 26 and 28 disposed beneath the furnace enclosure 30 to pass upwardly into the furnace enclosure 30 to fluidize and combust the particulate coal therein. The hot flue gases 7 formed during the combustion of the particulate coal within the furnace enclosure 30 pass from the furnace enclosure 30 into and through an evaporator section 32 disposed longitudinally downstream with respect to flue gas flow of the furnace enclosure 30. Evaporator section 32 houses a bank of heat exchange tubes through which water is passed in heat exchange with the hot flue gases 7 leaving the furnace enclosure 30. The hot flue gases 7 then traverse an economizer section 34 disposed longitudinally downstream with respect to flue gas flow of the evaporator section 32 to preheat the feed water being supplied to the boiler bank disposed within the evaporator section 32. The cooled flue gas 7 leaving the economizer bank 34 is directed through outlet conduit 36 to a particulate collector, such as a fabric filter, housed on an adjacent locomotive car (not shown).

The steam generated as the water passes through the boiler bank disposed within the economizer section 32 in heat exchange relationship with the hot flue gas 7 generated in the furnace enclosure 30, is collected in a longitudinally elongated steam drum 40 disposed above the evaporator section 32. The steam collected in the steam drum 40 is passed therefrom through an in-bed superheater 100 and thence to the steam powered generating means 22 to produce the power which drives the locomotive engine. A portion of the steam leaving the steam driven power generating means 22 is passed to an air preheater 38 where it passes in heat exchange with the incoming combustion air and is condensed thereby preheating the combustion air 5 being supplied to the furnace enclosure 30. The remaining steam is passed directly from the generating means 22 to the condenser 42 wherein the steam is condensed. Both condensate streams are returned to the water inlet header serving the economizer 34 as feed water for the boiler bank disposed within the evaporator section 32 and the fluid cooled walls of the furnace enclosure 30.

Figure 2:
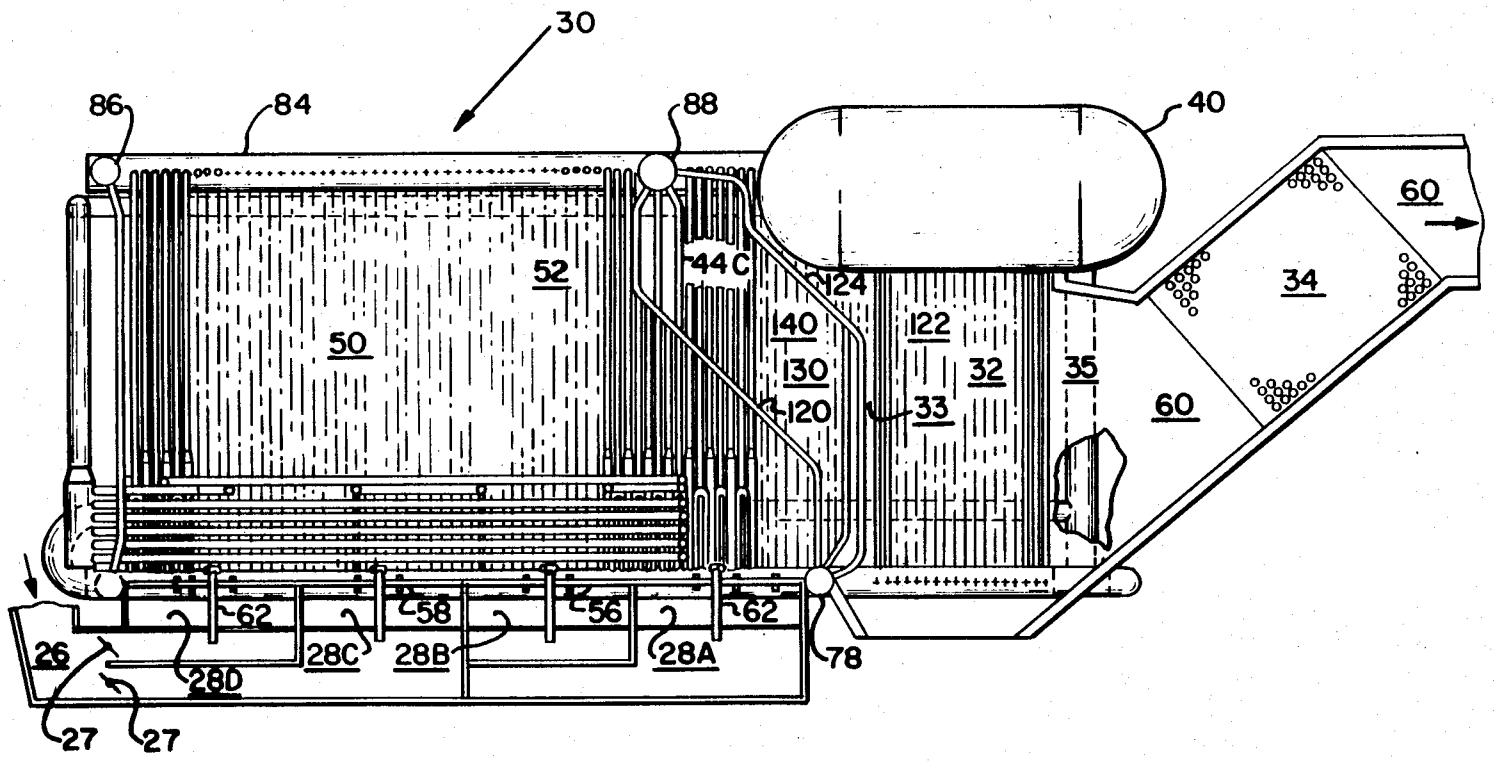
FIG. 2 is a sectional side elevation view detailing the preferred embodiment of the coal-fired fluidized bed steam generator of the present invention.

As best seen in FIG. 2, the steam generating fluidized bed furnace system of the present invention includes a longitudinally elongated furnace enclosure 30 formed of a plurality of fluid cooled tubes 44 enclosing a furnace chamber 50 having an open floor at the bottom thereof and a gas outlet 52 at one end thereof. An evaporator section 32 comprises a plurality of substantially vertically disposed heat exchange tubes extending from a pair of lower water inlet headers to an upper steam-water drum 40 disposed at the top of the evaporator section 32. The evaporator section 32 has a gas inlet 33 opening to the gas outlet 52 of the furnace chamber 50 for receiving the hot flue gas therefrom and a gas outlet 35 through which the flue gas having traversed the heat exchange tubes 54 of the boiler bank of the evaporator section 32 discharges into the flue gas duct 60. An economizer section 34 is disposed in the flue gas duct 60 and has an inlet 37 for receiving the hot flue gas from the evaporator section 32 and a gas outlet 39 for discharing the flue gas having traversed the economizer 34 back into the flue gas duct 60.

Figure 3:
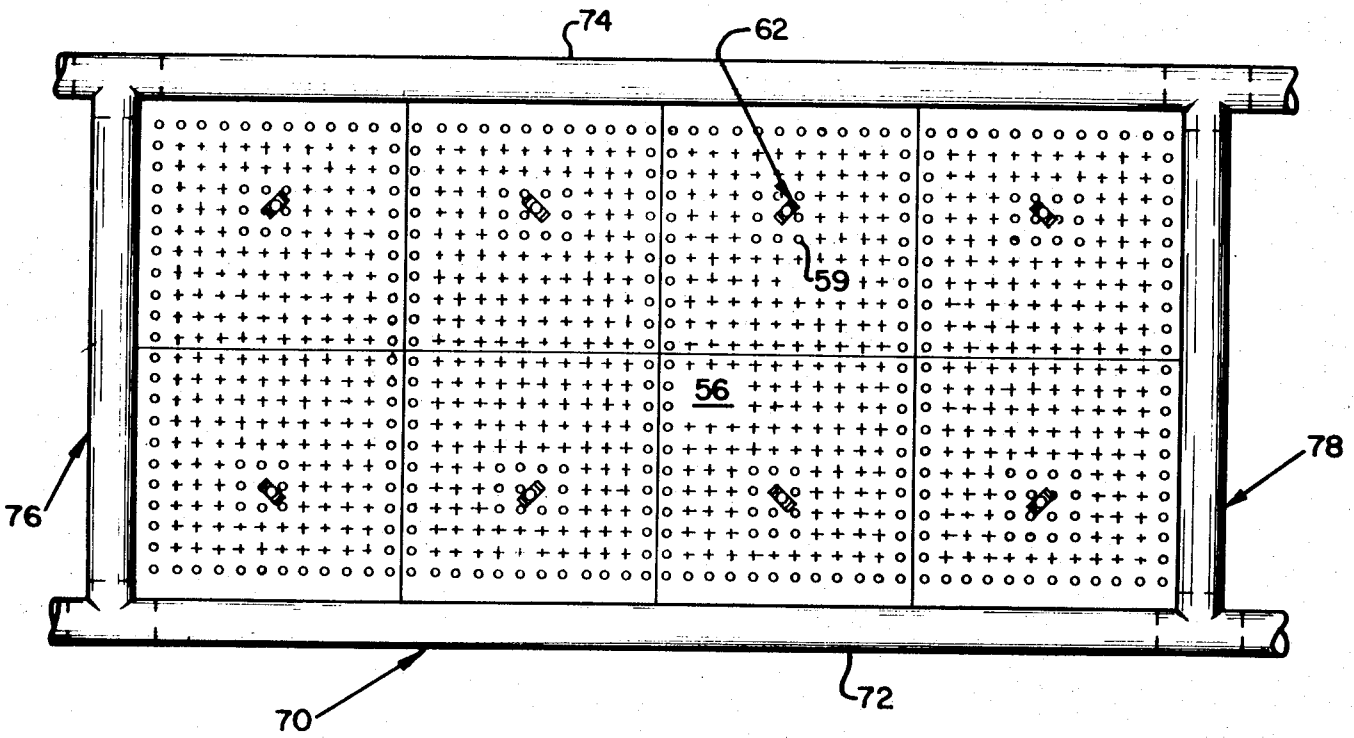
FIG. 3 is a plan view taken along line 3—3 of FIG. 2 showing the bed support plate, air distribution ports, fuel feed nozzles and lower tube wall inlet header arrangement.

Plate means 56 is disposed in the bottom of the furnace chamber 50 of the furnace enclosure 44 so as to extend across the open floor of the furnace chamber 50 for supporting a bed of fuel material and inert material within the furnace chamber 50. The fuel and inert material are supplied to the furnace chamber 50 pneumatically through feed line 24 from a tender car disposed adjacent to the locomotive engine car. The fuel and inert material pass upwardly from the feed line 24 which extends beneath the furnace enclosure 44 through feed nozzles 62 which extend upwardly from the feed line 24 through the bed support plate means 56 to open into the furnace chamber 50 superadjacent the bed support plate means 56. As each feed nozzle 62 is capable of supplying fuel to a limited portion of the bed, a number of feed nozzles are distributed over the plan area of the plate means 56 as illustrated in FIG. 3. Each feed nozzle 62 is independently controlled so that the flow of fuel through that nozzle may be stopped and started at will so as to slump or activate selective portions of the bed in response to load demand. An air supply plenum 28 is disposed subadjacent the bed support plate means 56. Air for fluidizing the inert material and coal to establish a fluidized bed within the furnace chamber 50 superadjacent the bed support plate 56 and also to combust the coal therein, passes upwardly from the air plenum 28 into the furnace chamber 50 through a plurality of passages 58 through the bed support plate means 56. As illustrated in FIG. 3, the passages 58 are formed in the bed plate 56 at fairly evenly distributed intervals across the plan area of the bed plate support means 56. Although the passages 58 shown in the preferred equipped with air nozzles 59, the passages 58 may comprise mere holes through the plate means 56 not equipped with any nozzle devices. Additionally, conventional bubble caps, not shown, are typically associated with each flow passage to prevent back flow of solids into the air plenum.

Figure 4:
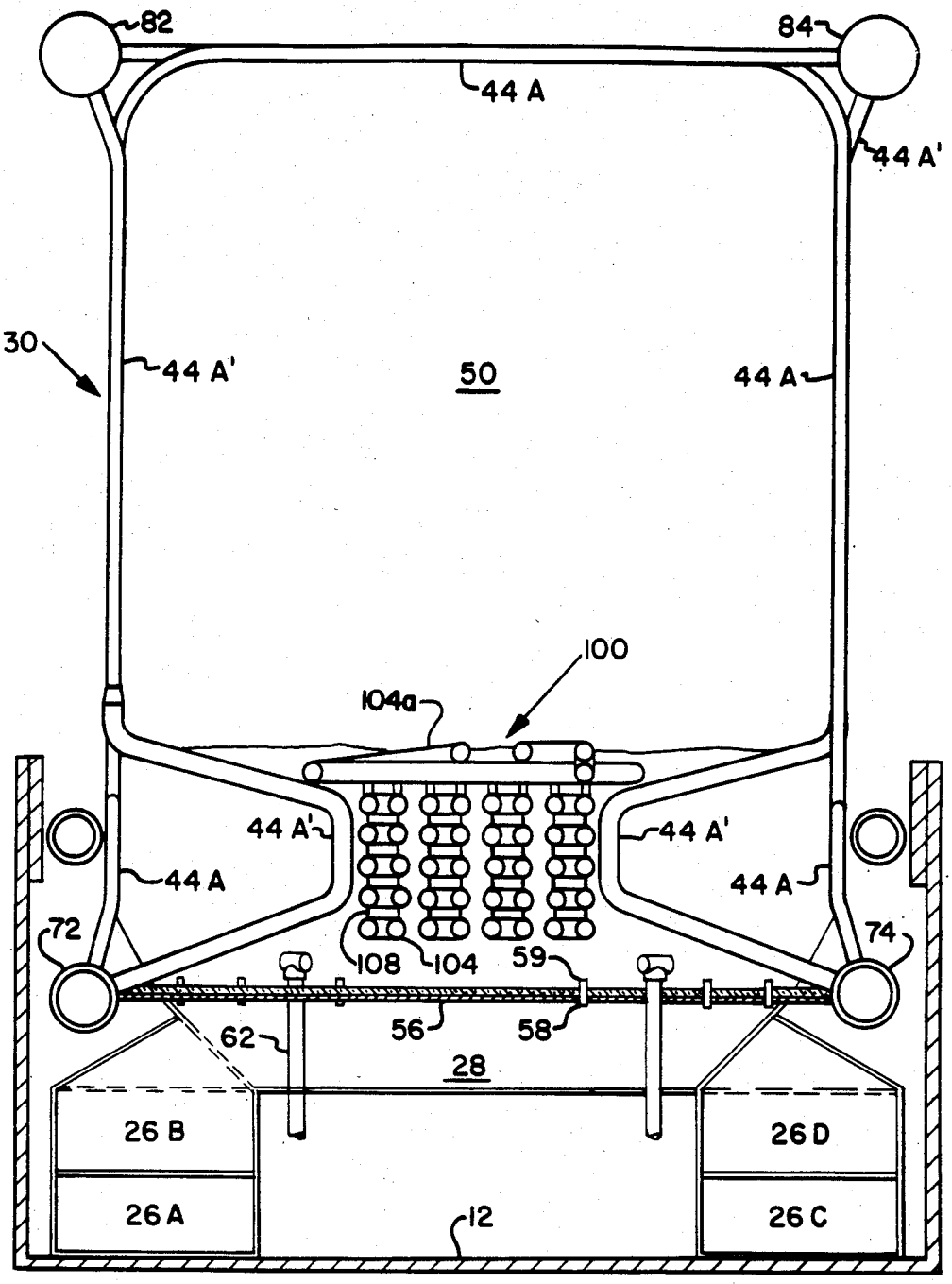
FIG. 4 is a transverse cross-sectional view of the fluidized bed steam generator of FIG. 2 taken along line 4—4.

Preheated combustion air is supplied to the air plenum 28 for distribution beneath the bed support plate means 56 through air supply ducts 26 which are disposed in laterally spaced relationship beneath the air plenum 28 as best seen in FIG. 4. Preferably, the air plenum 28 is subdivided in a longitudinal direction to provide two or more longitudinally adjacent compartments. The air supply ducts 26 are also preferably divided into two or more sub-ducts such that each sub-duct supplies fluidizing air to a particular compartment of the air plenum 28. A flow control damper 27 is provided in each sub-duct so that the amount of fluidizing air passed to each compartment of the air plenum 28 may be controlled in response to load and in coordination with the supply of fuel to the various sections of the bed through feed nozzles 62. For example, in the embodiment illustrated in the drawing as best seen in FIGS. 3 and 4, the air supply plenum 28 is subdivided into four longitudinally adjacent compartments 28A, 28B, 28C and 28D, each of which supply air to a separate section of the bed supported superadjacent the plate means 56 through the air flow passages 58 which open into it. Similarly, the air supply ducts 26 are each divided into two sub-ducts so as to provide four independent sub-ducts 26A, 26B, 26C and 26D serving, respectively, the air supply plenum compartments 28A, 28B, 28C and 28D.

The bed support plate means 56 and the air plenum 28, as well as the air supply ducts 26 disposed beneath it, are supported separately from the furnace enclosure 44. The bed support plate means 56 is mounted atop the air supply plenum 28 which is interconnected and supported from the air supply ducts 26 which are disposed beneath and at the sides of the air supply plenum 28. Each of the air supply ducts 26 are mounted atop and supported from the floor of the support cradle 12 of the locomotive engine. The furnace enclosure 44, including the waterwall tubes that make up the furnace enclosure and the headers connected to the waterwall tubes are supported from the lower waterwall inlet headers which are mounted in a conventional manner at a number of points, typically three, along their lengths to the side walls of the support cradle 12 of the locomotive engine. In this manner, the weight of the bed of fluidized material is borne by the bed support means 56 independently of the walls of the furnace enclosure and is transmitted to the floor of the support cradle 12. Thus, the furnace enclosure and the waterwall inlet headers need not to designed to support the weight of the bed of material.

The furnace enclosure 30 is formed of a plurality of water-cooled tubes 44 extending upwardly from a rectangular lower tube wall inlet header arrangement 70 disposed about the lower periphery of the furnace enclosure 30 to a rectangular upper tube wall outlet header arrangement 80 disposed about the upper periphery of the furnace enclosure 30 and vertically spaced above the lower tube wall inlet header arrangement 70. The lower rectangular tube wall inlet header arrangement 70 comprises a pair of laterally spaced longitudinally extending side wall inlet headers 72 and 74 and a pair of longitudinally spaced laterally extending end wall inlet headers 76 and 78 interconnected between the side wall inlet headers 72 and 74. The rectangular upper tube wall outlet header arrangement 80 comprises a pair of laterally spaced longitudinally extending side wall outlet headers 82 and 84, and a pair of longitudinally spaced laterally extending end wall outlet headers 86 and 88, each interconnected between the upper side wall outlet headers 82 and 84.

Figure 5:
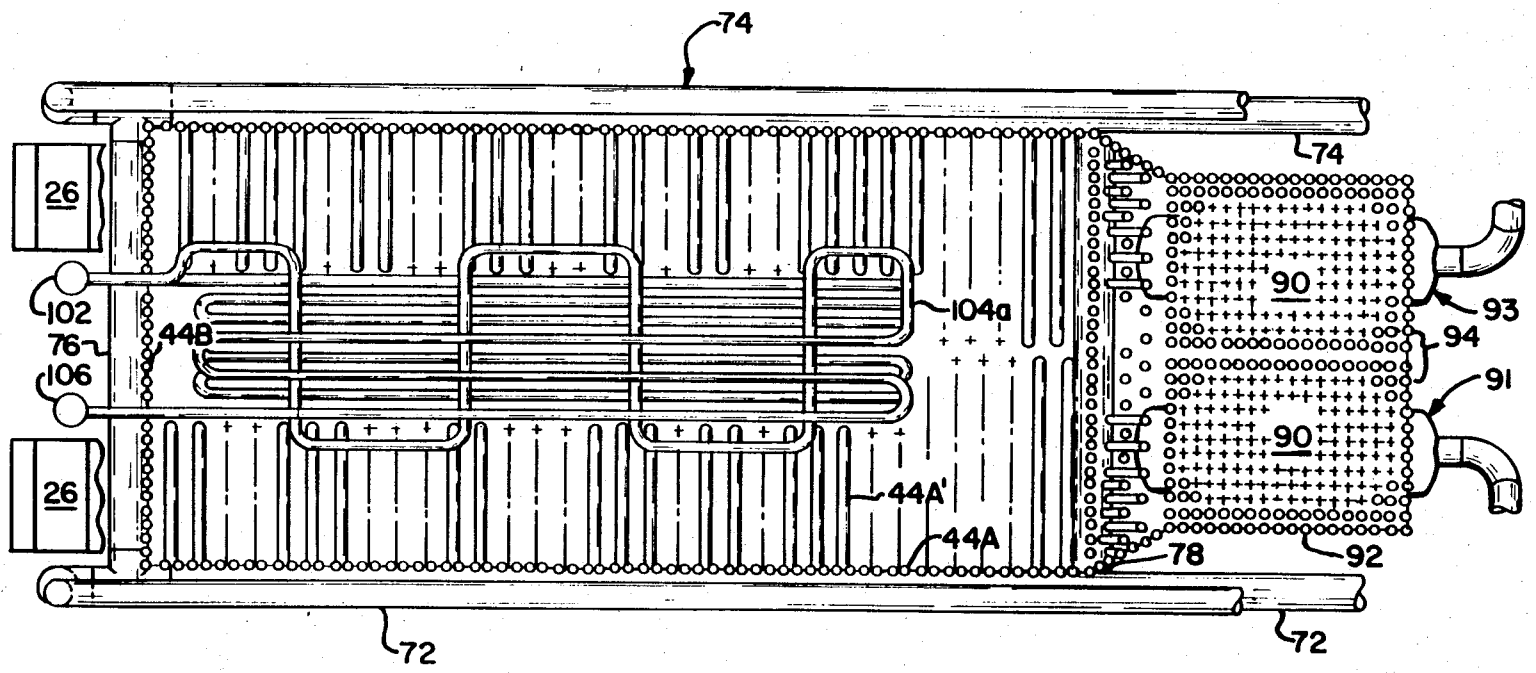
FIG. 5 is a longitudinal sectional plan view of the fluidized bed steam generator of FIG. 2 taken along line 5—5.
Figure 6:
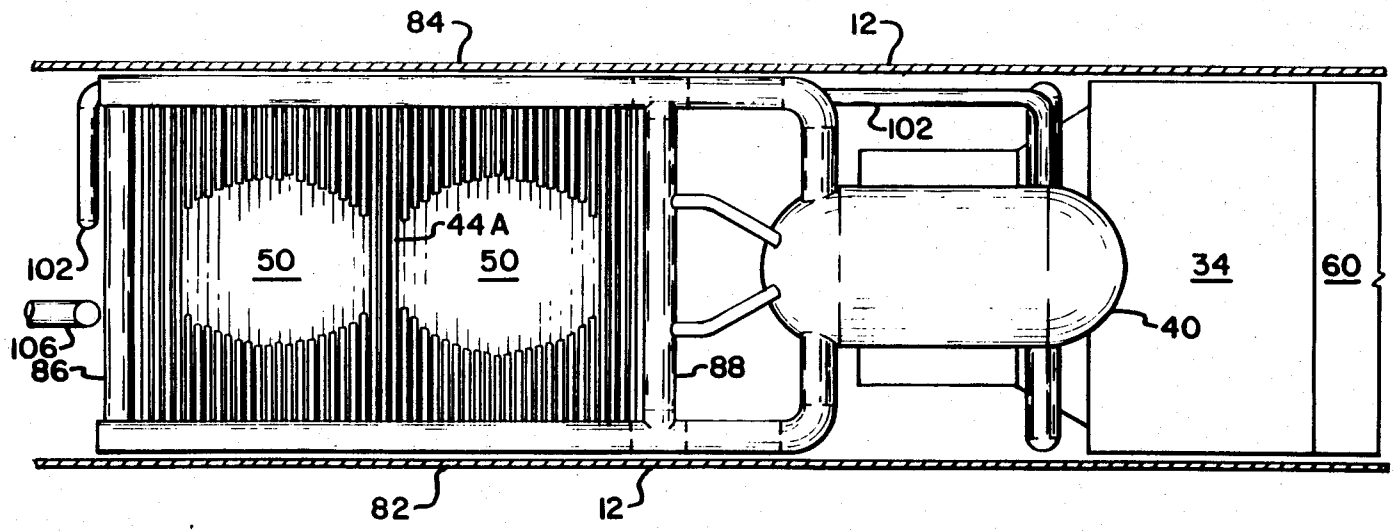
FIG. 6 is a plan view taken along line 6—6 of FIG. 2 showing the steam drum and upper tube wall inlet header arrangement.
Figure 7:
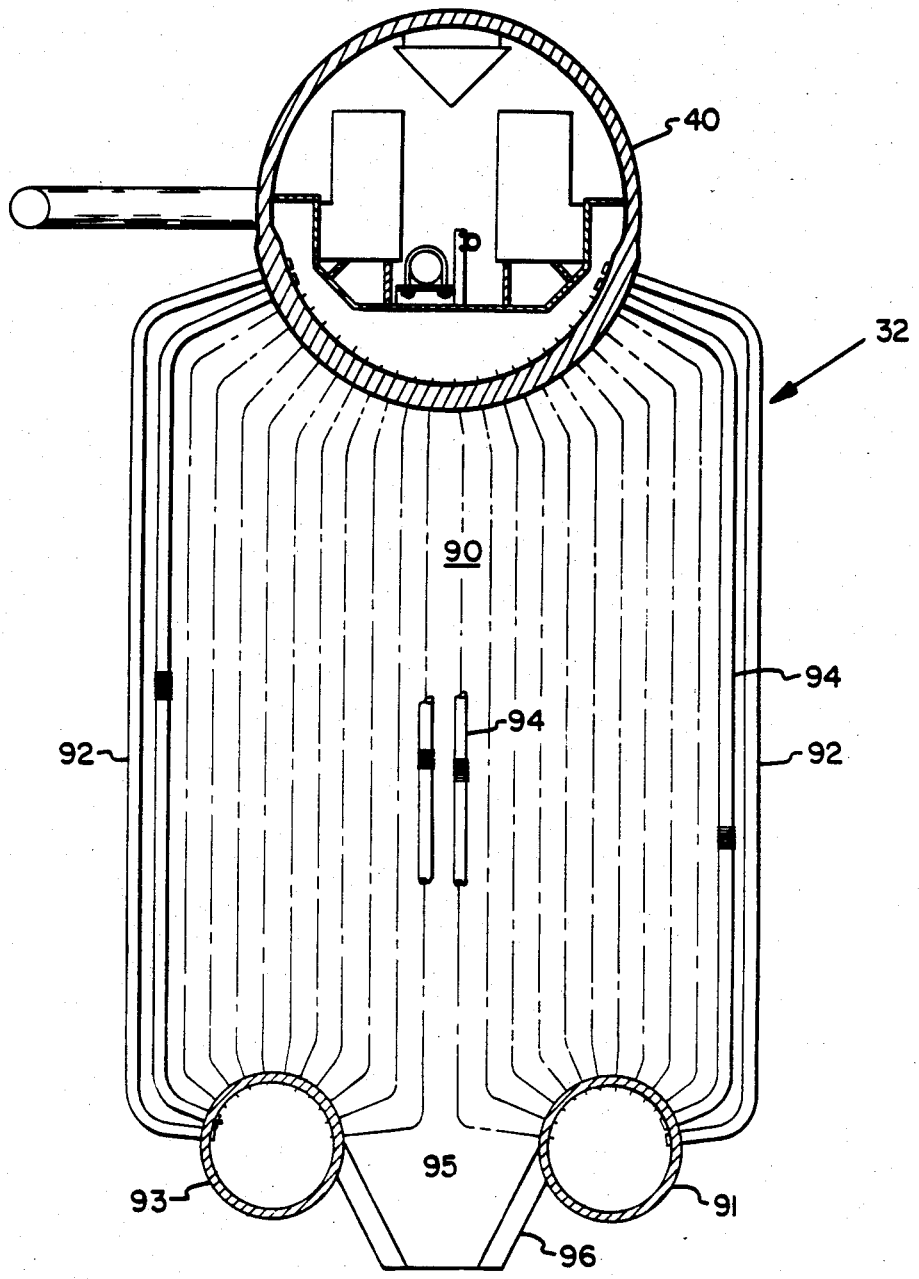
FIG. 7 is a transverse cross-sectional view of the evaporator section of the fluidized bed steam generator of FIG. 2 taken along line 7—7.

As best seen in FIGS. 2, 4 and 5, the furnace enclosure 30 is formed of a plurality of water-cooled tubes 44 welded together in side-by-side relationship with the side walls thereof being formed by tubes 44A and 44A', one end wall thereof being formed by tubes 44B, and the other end wall thereof being formed by tubes 44C. The roof of the furnace enclosure 30 is formed by the side wall tubes 44A which extend across the top of the furnace chamber 50 to connect with the upper side wall outlet header on the side of the furnace opposite the lower side wall inlet header from which the tubes originate.

Each of the tubes 44A is bifurcated at a point partially up the side of the furnace enclosure 30 to provide a double tube portion below the bifurcate and a single tube portion thereabove as best seen in FIG. 2. Each side wall 44A', however, is not bifurcated but remains a single tube having its lower portion bent inwardly into the bed. In this manner, the lower section of each of the side walls is formed of the double tube portion of the bifurcated tubes 44A, while upper section of each of the side walls is formed of the upper single tube portion of the bifurcated tubes 44A and the upper portion of the tubes 44A' disposed alternately in side-by-side relation.

As best seen in FIG. 4, each side wall tube 44A forming the left side wall extends substantially vertically upward from the left lower waterwall inlet header 72 to a point subjacent the left upper waterwall outlet header 82 whence it turns inwardly to extend across the top of the furnace chamber 50 to connect to the right upper waterwall outlet header 84. Similarly, each side wall tube 44A forming the right side wall extends substantially vertically upward from the right lower waterwall inlet header 74 to a point subadjacent the right upper waterwall outlet header 84 whence it turns inwardly to extend across the top of the furnace chamber 50 to connect to the left upper waterwall outlet header 82. In this manner, a water cooled roof is provided as an integral part of the furnace enclosure 30.

The closed end wall of the furnace enclosure 30, i.e. the end of the furnace chamber 50 remote from the evaporator section 32, is formed by a plurality of tubes 44B which extend in side-by-side relationship upwardly from the end wall inlet header 76 to the end wall outlet header 86 disposed thereabove. The open end wall of the furnace enclosure 30, i.e. the end of the furnace chamber 50 adjacent the evaporator section 32, is formed by a plurality of tubes 44C which extend upwardly from the end wall inlet header 78 to the end wall outlet header 88 in an upwardly included arrangement as best seen in FIGS. 2 and 5. As the upper end wall outlet header 88 is displaced from a location directly above the lower end wall inlet header 78 to a location over the furnace chamber 50, the end wall is in the form of an arch wall 120 established above the portion of the fluidized bed at the end of the furnace enclosure 30 adjacent the evaporator section 32. The tubes 44C first extend vertically upwardly from the end wall inlet header 78 to a position near the active bed height and thence extend inwardly into the furnace chamber 50 at an acute angle, preferably of about 45°, over the bed surface to form the arch portion of the wall 120 and thence upwardly to the end wall outlet header 88 which is positioned upstream with respect to gas flow of the end wall inlet header 78. The portion of adjacent tubes 44C constituting the inclined arch portion and the lower vertical portion of the wall 120 are welded together to form a barrier to flue gas while the upper vertical portion of the tubes 44C are arrayed in a staggered, spaced relationship so as to provide an open flow area between adjacent tubes thereby forming the gas outlet 52 of the furnace chamber 50.

Additional water-cooled tubes 122 extend upwardly from the lower end wall inlet header 78 to the upper end wall outlet header 88 so as to form a screen wall 124 downstream of the arch wall 120 to define a gas passage 140 therebetween for directing the flue gas leaving the furnace chamber to the evaporator section 32. As best seen in FIGS. 2 and 5, the tubes 122 first extend upwardly, substantially vertically, in a staggered, spaced relationship to provide an open flow area 130 therebetween at the base of the gas passage 140, and thence pass at an acute angle to the end wall outlet header 88 in side-by-side relationship, preferably substantially parallel to the arch wall 120. Flue gases generated in the furnace chamber 50 pass therefrom through the furnace outlet 52 in the upper portion of the arch wall 120 and thence downwardly along the gas passage 140 to enter the evaporator section 32 through the open flow area 130 in the lower portion of the screen wall 124. Due to the inclination of the arch wall 120, particulate material precipitating out of the flue gas passing through the gas passage 140 will slide along the arch wall and drop into the hopper disposed beneath the evaporator section 32.

Disposed downstream with respect to flue gas flow of the furnace chamber 50 is the evaporator section 32. The evaporator section 32 has a gas inlet 33 at the forward end thereof with respect to flue gas flow which is connected by the duct 140 to the gas outlet 52 of the furnace chamber 50 for receiving the hot flue gas therefrom. The outlet 35 of the evaporator section 32 is disposed longitudinally opposite the gas inlet 33 thereto at the rearward end of the evaporator section 32 and opens into the flue gas duct 60. Disposed between the gas inlet 33 and the gas outlet 35 is a boiler tube bank 90 wherein water is passed in heat exchange relationship with the hot flue gas flowing through the evaporator section 32 to evaporate a portion of the water to form steam which is then collected and superheated and supplied to the drive means 22 for powering the locomotive engine. Evaporator section 32 comprises the elevated longitudinally extending steam and water drum 40 disposed at the top of the evaporator section 32, a pair of laterally spaced, longitudinally extending lower water headers 91 and 93 disposed beneath and spaced from the steam and water drum 40, and a boiler bank 90 formed of a plurality of fluid- cooled tubes extending vertically upward from each of the lower inlet headers 91 and 93 to the steam and water drum 40. The lower water inlet headers 91 and 93 are spaced laterally apart and extend longitudinally along the length of the evaporator section to provide a longitudinally elongated open space 95 therebetween. Disposed between the lower water inlet headers 91 and 93 is trough means 96 which extends laterally across and longitudinally along and beneath the open area 95 formed between the inlet headers 91 and 93 so as to form a hopper bottom which extends longitudinally along the length of the evaporator section 32. The trough means 96 thereby provides a region for the collection of particulate matter including ash from the coal burned in the furnace chamber 50 as well as unburned char particles and any bed material elutriated from the fluidized bed in the furnace chamber 50. As the particulate matter collected in trough means 96 will typically have a high carbon content due to the presence of unburned char particles, this particulate matter will typically be mechanically or pneumatically recycled to the furnace chamber 50 to increase overall combustion efficiency.

The boiler bank 90 is formed of a first plurality of heat exchange tubes 92 which comprise the laterally outward- most tubes of the fluid cooled tubes of the boiler bank 90. These laterally outward-most tubes 92 are fin-welded to form the gas-tight side walls of the enclosure having the evaporator section defining a gas flow passage therebetween. The remaining tubes 94 of the boiler bank 90 are disposed inwardly of the laterally outward-most tubes 92 and extend upwardly from the lower water inlet headers 91 and 93 to the steam and water drum 40 through the gas flow passage. Preferably, the tubes 94 extending through the gas flow passage are provided with extended heat exchange surface such as fins in order to enhance the heat transfer from the hot flue gas flowing pass the boiler bank 90 to the water flowing within the boiler bank tubes 94.

Disposed downstream of the evaporator 32 with respect to flue gas flow in the flue gas 60 is the economizer section 34 which is formed of a plurality of heat exchange tubes 98 which extend transversely across the flue gas duct 60. Preferably, the heat exchange tubes 98 are aligned in a plurality of rows to form what is termed an in-line tube bank arrangement rather than a staggered tube bank arrangement. Disposing the heat exchange tubes 98 of the economizer section 34 in an in-line arrangement facilitates cleaning of particulate matter from the tubes as necessary. Preferably, the heat exchange tubes 90 in the economizer section 34 are also provided with extended heat transfer surface such as fins, particularly spiral fins. Feed water passes through the heat exchange tubes 98 in economizer section 34 in heat exchange relationship with the flue gas passing over the heat exchange tubes 98 to preheat the water which then passes to the drum 40 and thence through the downcomers to the lower evaporator inlet headers 91 and 93, and the lower waterwall inlet headers 72, 74, 76, and 78.

The steam generated in the tube walls of the furnace enclosure and in the boiler bank is collected in the drum 40 and passed therefrom through main steam conduit 99 to the inlet header 102 to the in-bed superheater 100. The in-bed superheater 100 comprises a plurality of serpentine tubes 104 interconnected between and extending outwardly into the bed from the inlet header 102 and the outlet header 106 as best seen in FIGS. 2 and 5. The inlet and outlet headers of the superheater 100 are disposed outside of the furnace enclosure 30 while the tubes 104 extend therefrom through the end wall formed by tubes 44B into the furnace chamber 50. The serpentine tubes 104 are supported within the furnace chamber 50 at a position below the active bed height by support spacer means 108 suspended downwardly from the superheater support tube **104*a*. The superheater support tube 104*a* is an integral part of the superheater 100 and extends from the inlet header 102 through the furnace chamber 50 in a criss-crossing manner from one lateral extremity of the superheater tube bundle 100 to the other lateral extremity thereof, and thence to the outlet header 106 as best seen in FIG. 5. The superheater support tube 104*a* from which the remainder of the superheater tubes 104 are supported is in turn at spaced intervals on portions 45 of the side wall tubes 44A' extending into the bed. The portions 45 of the side walls upon which the superheater support tube 104*a* is mounted are formed of the side wall tubes 44A' which extend first inwardly from the lower water wall inlet headers 72 and 74 into the furnace chamber 50 and thence outwardly to meet the side wall tubes 44A and extend vertically upwardly therewith to form the side walls of the furnace chamber 30. Additionally, the portions 45 of the side wall tubes 44A' extending into the furnace chamber 50**, and the in-bed superheater itself, serve to reduce the sloshing of the bed material which results from the motion of the locomotive in going uphill or downhill and around banked turns.

During start-up and low load operation, the section of the bed disposed beneath the arch wall 120 would be activated while the remainder of the bed would be slumped. This would be accomplished by supplying fuel only to the section of the bed beneath the arch and directing the fluidizing gas through air supply sub-duct 26 to compartment 28A of the air plenum. The flue gas generated in this section of the bed would be blocked by the arch wall 120 from passing directly through the outlet 52. Rather, the flue gas would necessarily have to flow back into the furnace chamber 50 and then turn to pass through the gas outlet 52 in the upper portion of the arch wall 120 into the flue gas passage 140 and thence into the evaporator section 32 through the open area 130 in the screen wall 124. Thus, the flue gas will have a somewhat longer residence time in the furnace chamber 50 thereby ensuring that any fuel particles elutriated from the bed during start-up have time to burn out before entering the boiler bank. Also, it is preferred that the superheater 100 be fore-shortened so as not to extend into the start-up and low load section of the bed. The presence of in-bed surface during start-up and low-load operation could result in a lowering of bed temperatures to an undesirably low level and also in the overheating of the surface itself as superheated steam would not be demanded at low loads.

We claim:

1. A fluidized bed furnace system wherein fuel is combusted to produce a flue gas which is passed in heat exchange relationship with a liquid to generate and superheat a vapor, comprising:

a. a longitudinally elongated furnace enclosure formed of a plurality of fluid-cooled tubes enclosing a furnace chamber having an open floor at the bottom thereof and a gas outlet at one end thereof, an evaporator section having a gas inlet opening to said furnace chamber and a gas outlet, and an economizer section having a gas inlet opening to said evaporator section and a gas outlet, said furnace chamber, said evaporator section and said economizer arranged longitudinally in that sequence with respect to flue gas flow;

b. a support base comprising plate means having a plurality of passages therethrough for admitting fluidizing air to the furnace chamber and adapted to extend across the open floor of said furnace chamber for supporting a bed of fuel material and an inert material, an air plenum disposed immediately subadjacent said plate means for supporting said plate means and directing air through the plurality of openings in said plate means into said bed to fluidize the fuel and inert material within the furnace chamber superadjacent said plate means, fuel feed means extending upwardly through said plate means into the furnace chamber for supplying fuel to said bed of fluidized material, and a support cradle disposed beneath said air plenum, the support cradle of said support base having a base member upon which said air plenum is supported and having longitudinally extending side members from which said furnace enclosure is supported independently of said air plenum; and c. a superheater tube bundle disposed within the furnace chamber and positioned therein so as to be immersed within said bed of fluidized material, said superheater tube bundle supported from a portion of the fluid-cooled tubes enclosing the furnace chamber.

2. A fluidized bed furnace system wherein fuel is combusted to produce a flue gas which is passed in heat exchange relationship with a liquid to generate and superheat a vapor, comprising:

a. a longitudinally elongated furnace enclosure formed of a plurality of fluid-cooled tubes enclosing a furnace chamber having an open floor at the bottom thereof and a gas outlet at one end thereof, an evaporator section having a gas inlet opening to said furnace chamber and a gas outlet, and an economizer section having a gas inlet opening to said evaporator section and a gas outlet, said furnace chamber, said evaporator section and said economizer arranged longitudinally in that sequence with respect to flue gas flow, said furnace enclosure comprising:

i. a rectangular lower tube wall inlet header arrangement having a pair of laterally spaced longitudinally extending side wall inlet headers and a pair of longitudinally spaced laterally extending end wall inlet headers;

ii. a rectangular upper tube wall inlet header arrangement disposed above and vertically spaced from said lower tube wall inlet header arrangement, said upper tube wall outlet header arrangement having a pair of laterally spaced longitudinally extending side wall outlet headers and a pair of longitudinally spaced laterally extending end wall outlet headers;

iii. a first plurality of fluid-cooled tubes extending upwardly from each of the lower side wall inlet headers to from the side wall of said furnace enclosure, a first portion of said first plurality of fluid-cooled tubes forming each side wall having a bifurcated lower portion extending substantially vertically upward from a lower side wall outlet header and a single tube upper portion extending substantially vertically upward to a position subsdjacent the upper side wall outlet header disposed above the side wall and thence extending across the top of said furnace chamber to connect with the upper side wall outlet header disposed above the opposite side wall thereby forming the roof of said furnace enclosure, and a second portion of said first plurality of fluid-cooled tubes extending first inwardly from a lower side wall inlet header into the furnace chamber and thence back outwardly to the side wall to extend substantially vertially upwardly to the upper side wall inlet header disposed above the side wall, the second portion of said tubes disposed alternately between the upper portion of the first portion of said tubes;

iv. a second plurality of fluid-cooled tubes extending upwardly from one end wall inlet header to the end wall outlet header disposed thereabove to form the first end wall of said furnace enclosure; and v. a third plurality of fluid-cooled tubes extending upwardly from the other end wall inlet header to the other end wall outlet header to form the second end wall of said furnace enclosure, said third plurality of fluid-cooled tubes arranged to form a gas outlet in the second end wall of said furnace enclosure; and b. a support base comprising plate means having a plurality of passages therethrough for admitting fluidizing air to the furnace chamber, and adapted to extend across the open floor of said furnace chamber for supporting a bed of fuel material and an inert material, an air plenum disposed immediately subadjacent said plate means for supporting said plate means and directing air through the plurality of openings in said plate means into said bed to fluidize the fuel and inert material within the furnace chamber superadjacent said plate means, fuel feed means extending upwardly through said plate means into the furnace chamber for supplying fuel to said bed of fluidized material, and a support cradle disposed beneath said air plenum, the support cradle of said support base having a base member upon which said air plenum is supported and having longitudinally extending side members from which said furnace enclosure is supported independently of said air plenum.

3. A fluidized bed furnace system wherein fuel is combusted to produce a flue gas which is passed in heat exchange relationship with a liquid to generate and superheat a vapor, comprising:

a. a longitudinally elongated furnace enclosure formed of a plurality of fluid-cooled tubes enclosing a furnace chamber having an open floor at the bottom thereof and a gas outlet at one end thereof, an evaporator section having a gas inlet opening to said furnace chamber and a gas outlet, and an economizer section having a gas inlet opening to said evaporator section and gas outlet, said furnace chamber, said evaporator section and said economizer arranged longitudinally in that sequence with respect to flue gas flow, said evaporator section comprising:

i. an elevated longitudinally extending steam and water drum;

ii. a pair of laterally spaced, longitudinally extending lower water headers disposed beneath and spaced from said steam and water drum;

iii. a plurality of fluid-cooled tubes extending upwardly from each of the lower water headers and connecting to said steam and water drum, the laterally outward-most tubes of said plurality of fluid-cooled tubes forming the gas-tight side walls of said evaporator section and defining a gas flow passage therebetween, the remainder of said plurality of fluid-cooled tubes disposed inwardly of said laterally outward-most tubes extending upwardly to said steam and water drum through said gas flow passage; and iv. trough means extending longitudinally between said spaced lower water headers from forming a hopper bottom extending longitudinally along said evaporator section to collect particulate material precipitating from the flue gas passing therethrough; and b. a support base comprising plate means having a plurality of passages therethrough for admitting fluidizing air to the furnace chamber, and adapted to extend across the open floor of said furnace chamber for supporting a bed of fuel material and an inert material, an air plenum disposed immediately subadjacent said plate means for supporting said plate means and directing air through the plurality of openings in said plate means into said bed to fluidize the fuel and inert material within the furnace chamber superadjacent said plate means, fuel feed means extending upwardly through said plate means into the furnace chamber for supplying fuel to said bed of fluidized material, and a support cradle disposed beneath said air plenum, the support cradle of said support base having a base member upon which said air plenum is supported and having longitudinally extending side members from which said furnace enclosure is supported independently of said air plenum.

* * * * *